United States Patent [19]

Agosta

[11] 3,937,445

[45] Feb. 10, 1976

[54] PROCESS AND APPARATUS FOR OBTAINING THE EMULSIFICATION OF NONMISCIBLE LIQUIDS

[76] Inventor: Vito Agosta, 42 Cherry Lane, Huntington, N.Y. 11743

[22] Filed: Feb. 11, 1974

[21] Appl. No.: 441,637

[52] U.S. Cl. ..... 259/4 R; 259/DIG. 30

[51] Int. Cl.[2] ..... B01F 5/00; B01F 3/08

[58] Field of Search ..... 259/4, DIG. 30; 251/124

[56] References Cited

UNITED STATES PATENTS

| | | | |
|---|---|---|---|
| 2,705,620 | 4/1955 | Borck | 259/DIG. 30 |
| 2,746,735 | 5/1956 | Bradford | 259/4 X |
| 2,957,203 | 10/1960 | Marshall | 259/7 X |
| 3,188,055 | 6/1965 | Lutjens | 259/4 |
| 3,230,924 | 1/1966 | Hughes | 259/DIG. 44 |
| 3,233,872 | 2/1966 | Bouyoucos | 259/4 |
| 3,744,762 | 7/1973 | Schlicht | 259/DIG. 30 X |

*Primary Examiner*—Harvey C. Hornsby
*Assistant Examiner*—Alan Cantor
*Attorney, Agent, or Firm*—Kane, Dalsimer, Kane, Sullivan and Kurucz

[57] ABSTRACT

A process and apparatus for obtaining the emulsification of two or more nonmiscible liquids is disclosed. The process includes the step of passing at least one of the liquids through a passive device in the flow path of the liquid. The passive device in its preferred form is so dimensioned that the liquid passes through a first section of decreasing cross-sectional area wherein the pressure for the liquid decreases below its Clausius-Calpeyron pressure for the temperature of the liquid thus resulting in the formation of bubbles in the liquid. The liquid containing bubbles then passes through a section of uniform cross-sectional area wherein the bubbles fully develop. Thereafter, the bubbles are permitted to violently contract and expand in a mixture of the two or more nonmiscible liquids to obtain the desired emulsification. A passive apparatus for obtaining the above is also disclosed.

12 Claims, 3 Drawing Figures

FIG. 1
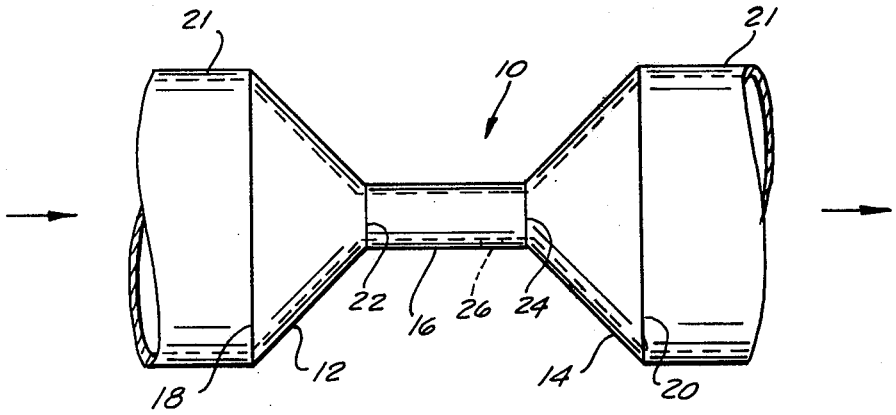
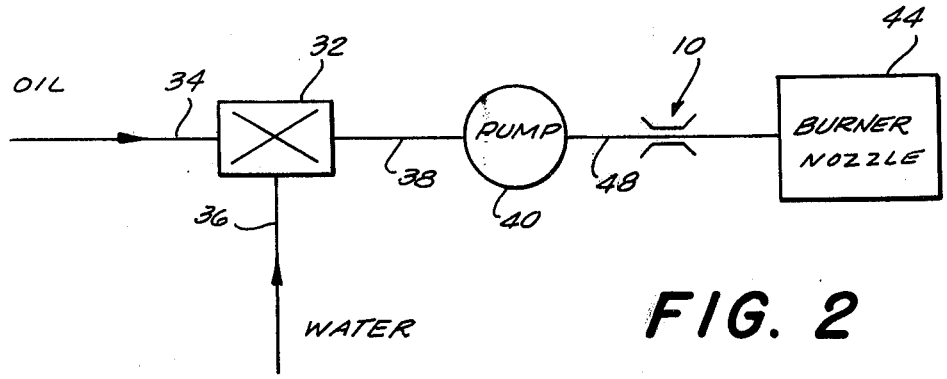
FIG. 2
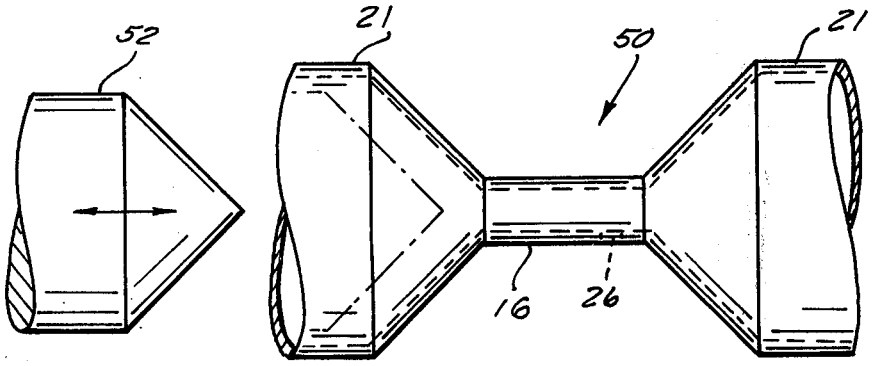
FIG. 3

PROCESS AND APPARATUS FOR OBTAINING THE EMULSIFICATION OF NONMISCIBLE LIQUIDS

BACKGROUND OF THE INVENTION

It has been known for some time that the burning characteristics of certain liquid fuels, such as common No. 2 heating oil, can be substantially ameliorated by emulsifying the oil with water. To this end, various mechanical oscillators have been designed and proposed to obtain the violent mixing action between the oil and water necessary to obtain the desired emulsion. One such device comprises an ultrasonic cavitator which agitates the oil and water mixture at a frequency of twenty thousand Hz in order to obtain the required agitation necessary to produce the desired emulsion. Such oscillators, while operating satisfactorily in some environments, are neither economically nor technically feasible for a multitude of other environments.

In view of the above, it is the principle object of the present invention to provide an improved process and apparatus for the emulsification of two or more nonmiscible liquids. A specific object of the present invention is to provide such a process and apparatus which may be incorporated into existing, automotive heating and power plant facilities with a minimum of expense or downtime. A further object is to provide such a process and apparatus which is completely passive and requires no external excitation power.

SUMMARY OF THE INVENTION

The above and other beneficial objects and advantages are attained in accordance with the present invention which provides a process for obtaining the emulsification of two or more nonmiscible liquids utilizing the step of causing cavitation of one or more of the liquids by passing the one or more liquids through a passive device in the flow path of the one or more liquids. The passive device includes a first section so dimensioned that the pressure for the one liquid decreases below its Clausius-Clapeyron pressure thereby tending to form bubbles. The bubble bearing liquid is then passed through to a second section of the device wherein the two or more nonmiscible liquids are mixed while the bubbles violently contract and expand with sufficient cavitation so as to produce the desired emulsion. Passive solid particles (such as powdered coal used to enrich the oil-water emulsion) or nonpassive solid particles that sublimate may be introduced with the nonmiscible liquids so as to form a suspension with the resultant emulsion.

BRIEF DESCRIPTION OF THE DRAWINGS

In the accompanying drawings:

FIG. 1 is a side elevational view of a passive cavitating device for use in accordance with the process of the present invention;

FIG. 2 is a schematic flow diagram for a system utilizing the present invention; and, FIG. 3 is a view similar to FIG. 1 including means for allowing for varying mass flow with constant upstream pressure.

DETAILED DESCRIPTION OF THE PREFERRED EMBODIMENT

As stated, the present invention relates to a process and apparatus for emulsifying two nonmiscible liquids. The following description will be directed specifically at the emulsification of a mixture of a fuel such as gasoline or oil and water although it should be understood from the outset that the present invention can be applied to the emulsification of other nonmiscible liquids as well.

Referring to FIG. 1, a venturi 10 capable of producing the desired cavitation action necessary for emulsification of oil and water is depicted. The venturi includes a section 12 having a converging pressure, a section 14 having a diverging passage and a throat 16 having a constant passage interposed between the two sections. An inlet 18 defines an entrance to the venturi 10 through the converging section and an outlet 20 defines an exit from the venturi through the diverging section 14. The venturi sections may be round in cross-section to facilitate connection with other pipes 21 of a system although this is not necessary.

Both the oil and water may be fed into venturi 10 through inlet 18 or just the oil or water may be fed through the inlet. In the latter case, the other of the nonmiscible liquids is introduced into the diverging section 14 or throat 16 of the venturi as will be described forthwith.

The outlet end 22 of the converging section 12 of the venturi is designed so that there is a pressure drop in the liquid which flows through this section sufficient to evaporate the liquid. The convergent section 12 should thus be designed so that the pressure of one or more of the nonmiscible liquids decreases below its equilibrium pressure for the liquid temperature. This pressure is dictated by the Clausius-Clapeyron relationship for the liquid for the temperature at which the liquid flows through the venturi and for some practical applications, the temperature of the liquid may be considered as room temperature.

The decrease in pressure of a fluid flowing through a convergent pipe is related to the ratio of the areas at the inlet and outlet ends. Accordingly, convergent section 12 of the venturi may be designed to obtain a sufficient pressure drop to obtain evaporation of one or more of the liquids. The decrease in pressure of the liquid(s) below its (their) vapor pressure(s) results in evaporation of the liquid(s) resulting in the formation of the initial stages of bubbles.

Under conditions of thermodynamic equilibrium, bubble formation should appear instantly at the outlet 22 of convergent section 12. However, thermodynamic equilibrium does not exist in the real world and tests have shown that a relaxation time is necessary for bubbles to be produced. Accordingly, section 16 which is a constant diameter throat is provided. In the throat section the process of evaporation of the oil and/or water advances to produce a large number of small bubbles in the liquid (or liquids). The bubbling liquid then flows into the divergent section 14 of the venturi through the outlet 24 of the throat section 16. In addition, all the nonmiscible liquids of the emulsion not passed through the first section of the venturi are introduced into the second section through a suitable inlet. In the divergent section the bubbles contract and expand as the pressure increases. The successive oscillations of the bubbles cause large stresses in the liquid mixture which tears the components of the liquid stream up into ligaments and due to surface tension, utlimately into smaller droplets. The disruptive forces on the oil and water of the mixture produces the desired emulsion.

As stated, both the oil and water components of the desired resultant emulsion may be introduced into the venturi through the inlet 18 to the convergent section 12. The design of the convergent section outlet 22 may be such as to produce a pressure drop below the critical Clausius-Clapeyron pressure for both the water and oil components or just the water or oil component.

Alternately, just the oil or water component may be passed through the venturi convergent section with the other component introduced downstream through an opening 26 so that the violent mixing resulting in the desired emulsion can be produced in the divergent section 14 of the venturi. Additionally, if desired, passive solid particles, such as powdered or granular coal, can be introduced with the oil and water components to further improve the utility of the resultant fuel. To this end, the introduction of powdered coal (100–300 sieve) into emulsified No. 2, 4 or 6 heating oil has been suggested to improve the utility of the fuels. Also, active solid particles (such as particles of dry ice) can be introduced to sublimate and thereby produce bubbles for subsequent cavitation of the nonmiscible liquids.

In FIG. 2, a schematic representation of a system incorporating the present invention is depicted. In this system, oil and water are fed to a mixing valve 32 through pipes 34 and 36 respectively. The mixture then flows through pipe 38 to a pump 40 which feeds burner 44 through pipe 48. In line with pipe 48 there is provided a passive, cavitating device 10 as described above. This results in an oil-water emulsion flowing from the outlet of the passive device 10 through pipe 48 and into burner 44 in a conventional manner.

In a successful practice of the present invention, No. 2 fuel oil was emulsified with water by passing both the water and oil through a venturi at the rate of approximately 7 gallons per hour. The venturi converging section was 0.250 inch long, the diverging section was 0.500 inch long and the throat was 0.500 inch long. The diameter of the converging section inlet was 0.187 inch, the diameter of the throat was .020 inch and the diameter of the diverging section outlet was 0.187 inch. The resulting emulsion was 70% oil and 30% water. The size of the droplets were between 2 and 12 microns.

In FIG. 3 a venturi 50 similar to that shown in FIG. 1 is depicted. Venturi 50 is provided with a pintle 52 which can be moved axially into and out of the converging section of the venturi to permit the minimum flow area into the venturi to be varied. This permits the upstream mass flow through the venturi to be varied at constant pressure. Such variation may be necessary, for example, to accommodate start up or peak level flow which may vary significantly from steady state flow.

It is important to the present invention and should be emphasized that the emulsification of the two or more nonmiscible liquids results solely as a result of one or more of the nonmiscible liquids flowing through a passive cavitation device. No external power is necessary to produce the desired cavitation. There are no parts to break down, become worn, or in other ways to malfunction.

While only one embodiment of my invention is disclosed in the foregoing, it should be appreciated that other passive devices such as a cavitating airfoil and/or wedge may be designed which could provide the pressure decrease and increase necessary for cavitation to obtain emulsification in accordance with my invention. Further, while the invention was described in the particular environment of emulsifying oil and water, it should be appreciated that other nonmiscible liquids, such as gasoline and water, two nonmiscible fuels, etc., have similarly been emulsified. Accordingly, the scope of my invention should not be limited to the described embodiment but rather should be determined by the following claims.

Having thus described the invention, what I claim is:

1. A process for obtaining the emulsification of two or more nonmiscible liquids comprising the steps of:

reducing the pressure of at least one of said liquids below its Clausius-Clapeyron pressure;

maintaining said liquid at said reduced pressure for a finite time period until bubbles form; and, permitting said bubbles to violently contract and expand in the presence of said two or more nonmiscible liquids.

2. The process in accordance with claim 1 wherein: said pressure is reduced by passing said liquid through a passage of decreasing cross-sectional area;

said pressure is maintained by passing said liquid through a passage of constant cross-sectional area; and, said bubbles are permitted to violently contract and expand by passing said liquid through a passage of increasing cross-sectional area.

3. The process in accordance with claim 1 including the step of introducing the remainder of said two or more nonmiscible liquids into said passive device at a point downstream of said first section.

4. The process in accordance with claim 1 comprising the additional step of introducing particles of solid material into said passive device suspended in said one or more liquids.

5. The process in accordance with claim 4 wherein said solid particles are of a size of between 100 and 300 sieve.

6. The process in accordance with claim 4 wherein said solid particles are formed of a material capable of sublimating.

7. The process in accordance with claim 1 wherein said nonmiscible liquids include a hydrophobic fuel and another of said nonmiscible liquids comprises water.

8. A process for obtaining the emulsification and combustion of two or more nonmiscible liquids including a combustible fuel comprising the steps of:

reducing the pressure of at least one of said liquids below its Clausius-Clapeyron pressure by passing said liquid through a passage of decreasing cross-sectional area;

maintaining said liquid at said reduced pressure for a finite time period until bubbles form by passing said liquid through a passage of constant cross-sectional area;

permitting said bubbles to violently contract and expand in the presence of said two or more nonmiscible liquids by passing said liquid through a passage of increasing cross-sectional area whereby to form a combustible emulsion; and, feeding said emulsion to a combustion device whereby to effect combustion of said emulsion.

9. A passive device for effecting the emulsification of two or more nonmiscible liquids, said device comprising a venturi having a converging section, an inlet into said converging section for introducing at least one of said nonmiscible liquids into said venturi, an outlet from said converging section, said converging section being so dimensioned that the pressure of said one liquid decreases below its Clausius-Clapeyron pressure at said outlet when said liquid passes through said converging section thereby tending to form bubbles in said one liquid; a diverging section of said venturi downstream of said converging section outlet, said diverging section being dimensioned to permit said bubbles to violently contract and expand; and a throat section of constant diameter extending between said converging and diverging sections, said throat having a constant diameter equal to that of the converging section outlet.

10. The device in accordance with claim 9 wherein one of said second and throat sections includes inlet means therein for receiving the remainder of said nonmiscible liquids.

11. The device in accordance with claim 9 further comprising means for varying the minimum area of said inlet so that variable mass flow can be achieved. being

12. A passive device for effecting the emulsification and combustion of two or more nonmiscible liquids, said device including a venturi having a converging section, an inlet into said converging section for introducing at least one of said nonmiscible liquids into said venturi, an outlet from said converging section, said converging section being so dimensioned that the pressure of said one liquid decreases below its Clausius-Clapeyron pressure at said outlet when said liquid passes through said converging section thereby tending to form bubbles in said one liquid; a diverging section of said venturi downstream of said converging section outlet, said diverging section being dimensioned to permit said bubbles to violently contract and expand; and a throat section of constant diameter extending between said converging and diverging sections, said throat having a constant diameter equal to that of the converging section outlet; a combustion device and means interconnecting the outlet of said venturi diverging section with said combustion device.

* * * * *